US011248887B2

(12) United States Patent
Geno

(10) Patent No.: US 11,248,887 B2
(45) Date of Patent: Feb. 15, 2022

(54) ARCHERY ARROW WRAP SYSTEM

(71) Applicant: Range-O-Matic Archery Co., Ray Township, MI (US)

(72) Inventor: Ray E. Geno, Macomb, MI (US)

(73) Assignee: Range-O-Matic Archery Co., Ray Township, MI (US)

( * ) Notice: Subject to any disclaimer, the term of this patent is extended or adjusted under 35 U.S.C. 154(b) by 0 days.

(21) Appl. No.: 16/879,433

(22) Filed: May 20, 2020

(65) Prior Publication Data

US 2021/0364259 A1 Nov. 25, 2021

(51) Int. Cl.
*F42B 6/06* (2006.01)

(52) U.S. Cl.
CPC ..... *F42B 6/06* (2013.01)

(58) Field of Classification Search
CPC ..... F42B 6/06
See application file for complete search history.

(56) References Cited

U.S. PATENT DOCUMENTS 4,927,478 A 5/1990 Erickson
7,455,605 B2 * 11/2008 Rangel ..... F42B 6/06 473/586
7,485,057 B2 * 2/2009 Afshari ..... F42B 6/06 473/586
8,118,695 B2 * 2/2012 Sutherland ..... F42B 6/06 473/586
9,046,329 B2 * 6/2015 Blosser ..... F42B 6/06
2002/0028718 A1 * 3/2002 Coe ..... F42B 6/06 473/586
2015/0292844 A1 * 10/2015 DeMille ..... F42B 6/06 473/586
2016/0010960 A1 * 1/2016 Castruita ..... F42B 6/06 473/586

OTHER PUBLICATIONS https://worldarchery.org/news/140800/archery-101-how-fletch-arrow-spin-vanes downloaded May 15, 2020.

* cited by examiner

*Primary Examiner* — John A Ricci
(74) *Attorney, Agent, or Firm* — Warner Norcross + Judd LLP

(57) ABSTRACT

A vane wrap for a projectile is provided where the wrap includes a base configured to wrap entirely around a circumference of a projectile, such as an arrow, and adhere to the arrow. The base includes an outward facing surface having a set of adhesive strips which are placed in predetermined locations and equally spaced about the circumference when the base is applied to the arrow. Each adhesive strip can include an individual corresponding release liner removable from the strip to expose the respective adhesive for application of a vane thereto, and to the arrow in predetermined locations about a circumference of the arrow. A related method of use also is provided.

20 Claims, 10 Drawing Sheets

ARCHERY ARROW WRAP SYSTEM

BACKGROUND OF THE INVENTION

The present invention relates to archery products, and more particularly to a vane wrap system on an archery arrow to stabilize the arrow in flight.

Archery arrows typically are outfitted with feathered or polymeric vanes to stabilize the arrows in flight. Vanes produce lift and lateral force on the arrow, which in turn stabilizes the arrow's flight pattern by moving the center of pressure rearward. In turn, this usually provides consistent arrow flight and can improve shot accuracy.

Some manufacturers utilize special features of vanes to improve arrow flight and stablization. For example, some arrow vanes are curved to include a spiral shape. A popular arrow vane used by many archers is the SPINWING arrow vane, available from Range-O-Matic Archery Company of Ray, Mich. Sets of this arrow vane, and many other similar types, are typically applied to arrows with multiple, narrow strips of tape. To apply the vanes, a user must apply a set of markings, typically with a marker, around the circumference of the arrow, corresponding to future locations of each vane. The user then tediously applies multiple individual strips of tape over the markings, being careful to align each strip with the marking. Then, the user aligns each individual vane with a respective individual strip of tape, pressing the vane onto the tape.

While this application works, it is very tedious. There can be issues if the original markings on the arrow are off, as that will cause the vanes to be applied improperly, misalign the vanes, and typically cause off balanced spin and flight. Further, the pieces of tape are to be applied perfectly aligned with the markings, again assuming they are straight. If the tape is off, then the applied vane likely will be too, or the vane will not contact enough tape to properly attach the vane to the arrow. The strips of tape also are tiny, and require special attention to detail and placement. Typically, the strips are longer than the vanes, so the tiny strips also need to be carefully cut after placement of the vanes, which can add an extra, time-consuming step. In addition, due to the individual nature of the strips and vanes, the vanes can be imprecisely taped, so they might not attach fully and can detach from the arrow, or can be misaligned to cause erratic flight or less than perfect stabilization of the arrow.

Accordingly, there remains room for improvement in the field of archery vane attachment to an arrow.

SUMMARY OF THE INVENTION

A vane wrap for a projectile is provided where the wrap includes a base configured to wrap entirely around a circumference of a projectile, such as an arrow, and adhere to the arrow. The base includes an outward facing surface having a set of adhesive strips which are placed in predetermined locations and equally spaced about the circumference when the base is applied to the arrow. Each adhesive strip can include an individual corresponding release liner removable from the strip to expose the respective adhesive for application of a vane thereto, and to the arrow in predetermined locations.

In one embodiment, the base can be provided in a flat, planar sheet form. The base can include a lower surface and an opposing upper surface, a longitudinal axis, and a width perpendicular to the longitudinal axis. The lower surface can include an adhesive layer that is coextensive with the entire lower surface. The upper surface can include two or more elongated, individual adhesive strips aligned with the longitudinal axis and disposed across the width at a predetermined spacing from one another.

In another embodiment, the base sheet can include a first end edge and a second end edge distal from one another, at opposite ends of a length of the base sheet. The base sheet can also include a first side edge and a second side edge opposite one another, across the longitudinal axis. The base releaser liner can be coextensive with the base sheet on the lower surface, extending entirely to the first end edge, the second end edge, the first side edge, and the second side edge. The release liner can cover a base adhesive layer on the lower surface that also is coextensive with the base sheet to the edges.

In still another embodiment, a first adhesive strip and a second adhesive strip can be disposed on the upper surface of the base sheet, opposite one another across the longitudinal axis of the base. Each strip can be inwardly disposed from the first and second side edges, as well as the first and second end edges.

In yet another embodiment, first strip can be spaced a predetermined first distance from the second strip at respective centerlines of the strips. The first distance can be one half, one third or one quarter the circumference of the arrow to which the base sheet is to attach.

In even another embodiment, the strips can be placed on the base such that the strips closest to the side edges lay unequal distances from the side edge to which they are closest. In this manner, the one side edge can form an overlap region such that when wrapped around the circumference of an arrow, the first and second side edges overlap.

In a further embodiment, the base can include a first adhesive strip and a second adhesive strip, each covered by respective first and second release liners. The adhesive strips and the release liners can each be of a second length that is shorter than a first length of the base sheet.

In still a further embodiment, a first upper end of a first adhesive strip and second upper end of a second adhesive strip can be each disposed a first end distance from the first end edge. A first lower end of a first adhesive strip and second lower end of a second adhesive strip can be each disposed a second end distance from the second end edge. The first end distance can be less than the second end distance so that the base sheet extends a greater length beyond the adhesive strips below them, closer to an arrow tip, than above them, closer to an arrow nock, on an arrow.

In yet a further embodiment, the base sheet can be outfitted with three or four or more adhesive strips and corresponding release liners. Thus, three vane, four vane or other vane configurations on arrows can be produced with the vane wrap.

In even a further embodiment, a method of installing vanes on an archery arrow is provided. The method can include providing the vane wrap; removing a base release liner from the base adhesive layer; adhering the base sheet around a circumference of an archery arrow with the base adhesive layer so that the vane wrap follows the contours of the archery arrow and wraps around the circumference; removing a first release liner from the first adhesive strip; applying a first vane to the first adhesive strip; removing a second release liner from the second adhesive strip; and applying a second vane to the second adhesive strip.

The vane wrap of the current embodiments is well-suited to precisely and efficiently apply individual vanes to an arrow. With the preplaced adhesive strips on the base sheet, a user can quickly apply vanes at those locations with little guesswork. The exact, low tolerance positioning of the adhesive strips across the width of the base sheet and thus the circumference of the arrow to which it is attached provides precise and consistent orientation and positioning of the vanes about the arrow. In turn, the applied vanes precisely and predictably provide consistent spin and stabilization of the arrow or projectile in flight. The base sheet also provides a versatile platform to two, three or four adhesive strips so that a corresponding number of vanes can be precisely applied to the base to a user's preference. The vane wrap also makes the application of vanes to the vane wrap less tedious and much less time consuming than conventional vane application systems.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

A vane wrap for use with a projectile in accordance with a current embodiment is illustrated in FIGS. 1-8 and generally designated 10. The vane wrap 10 can be joined with a projectile 100, and a number of vanes V1 and V2 can be joined to that wrap and thereby secured to the arrow. The vane wrap 10 can be attached to the projectile using adhesives, fasteners or other devices. As shown, the vane wrap is used to attach two similar vanes that are disposed radially around an outer surface of the projectile 100. The vane wrap 10 can locate the two vanes at regular intervals around the outer surface, for example, they can be spaced at 180° apart as shown, of course, other spacing intervals can be used as well, such as 120° intervals for three vanes, 90° intervals and so on. The outer surface 101 of the arrow can be substantially cylindrical as shown, or can take on other geometric shapes. The projectile 100 can be an arrow, however, as used herein, projectile can refer to any type of arrow, bolt, spear, or other elongated device intended to be shot, launched or thrown. Further, as used herein, an archery arrow can include an arrow or a bolt for use with bows, such as recurve bows, long bows, compound bows, cross bows and the like, as well as any type of spear or other elongated device intended to be shot, launched or thrown.

Figure 1:
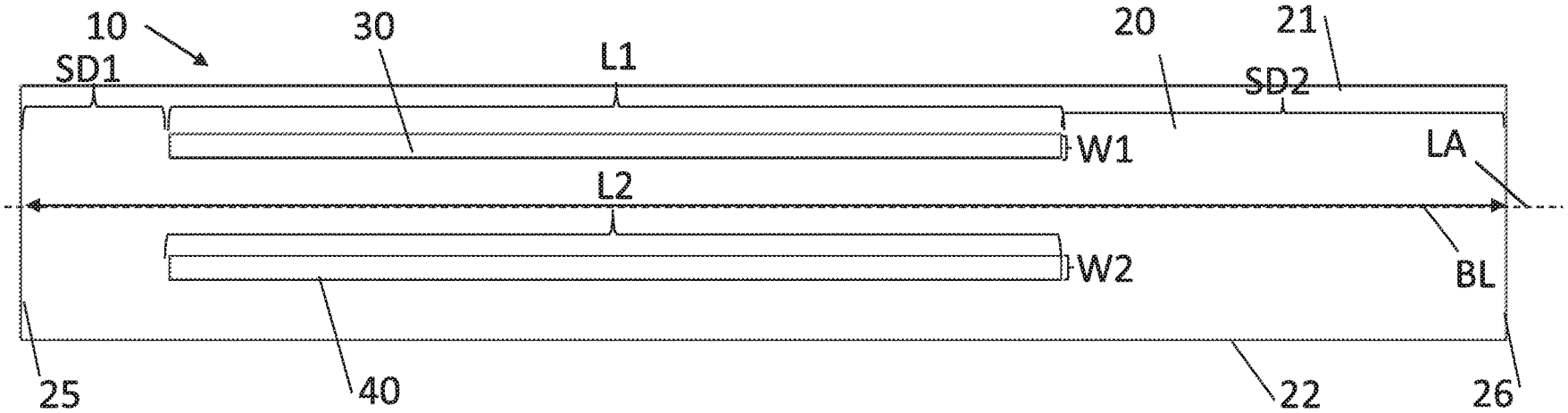
FIG. 1 is a top plan view of an archery vane wrap of a current embodiment in a planar form.
Figure 2:
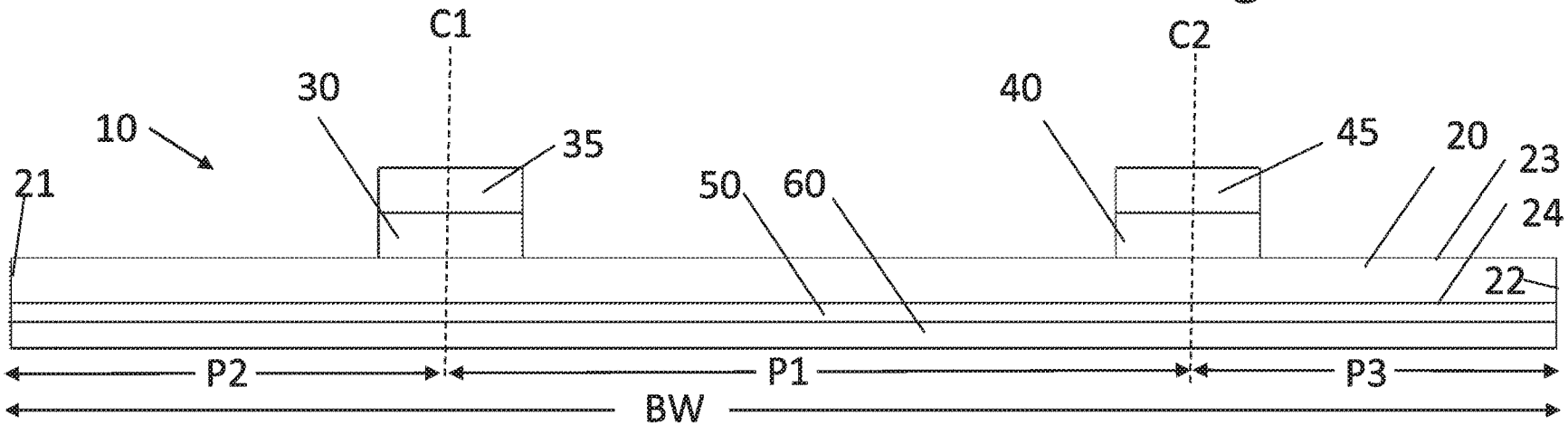
FIG. 2 is an enlarged top view thereof showing multiple adhesive strips on a base sheet with release liners attached to the adhesive strips and the base sheet.
Figure 8:
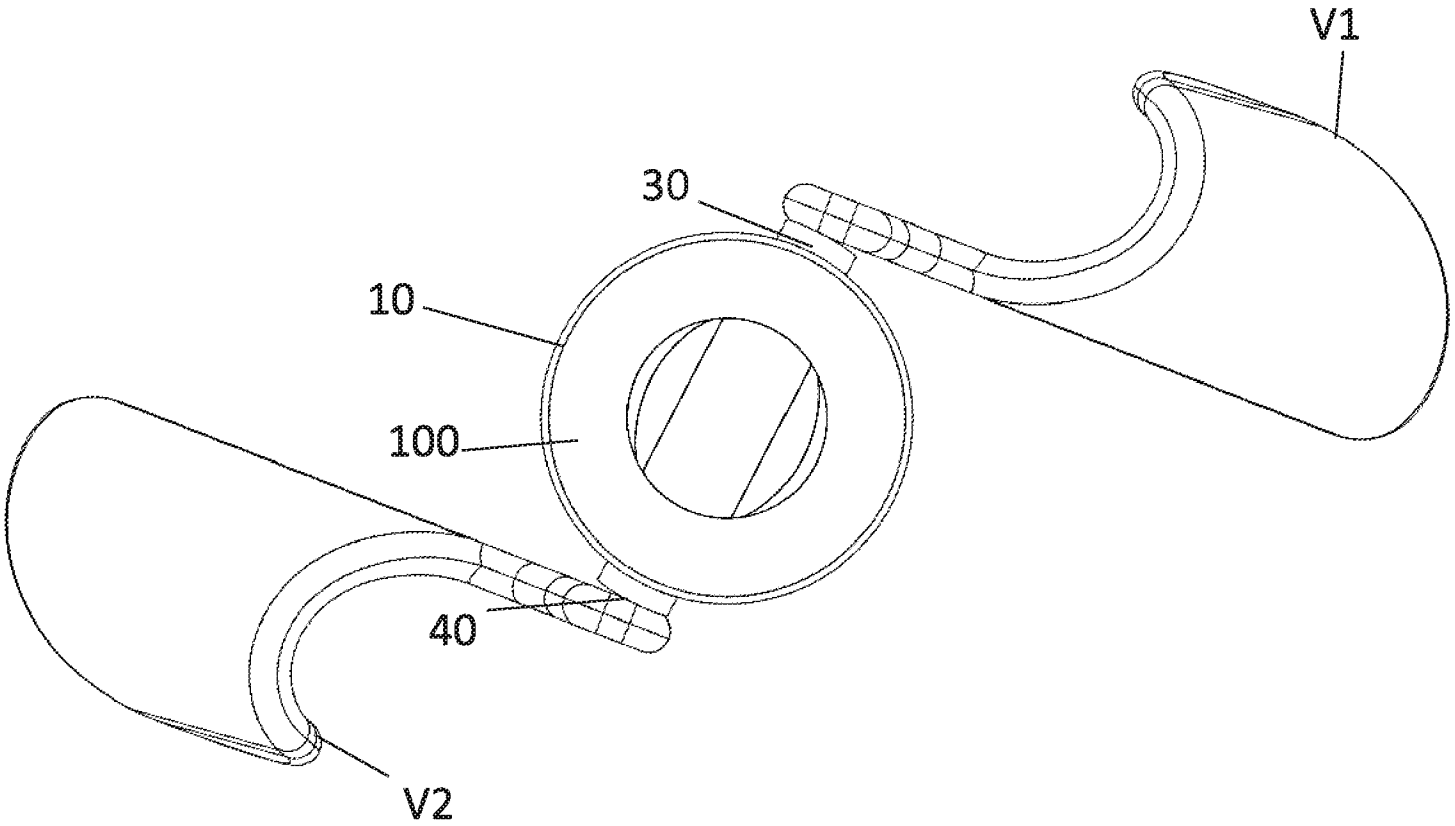
FIG. 8 is a rear view of a pair of arrow vanes applied to the arrow via the vane wrap.
Figure 9:
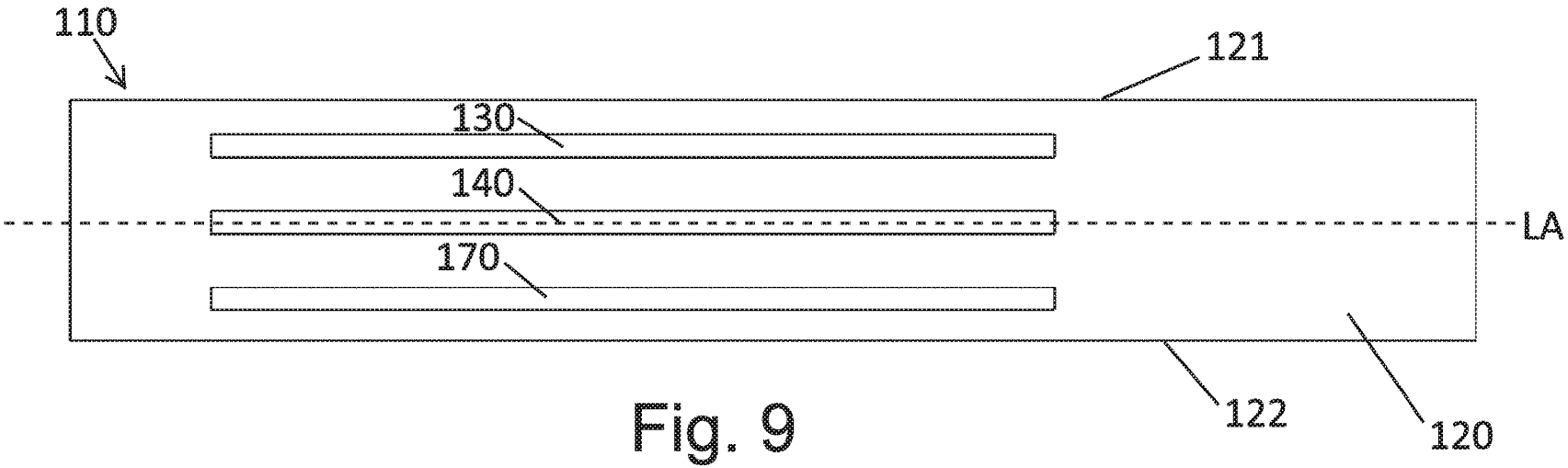
FIG. 9 is a top plan view of an archery vane wrap of a first alternative embodiment in a planar form.

As shown in FIG. 1, the vane wrap 10 shown there can include a base 20, a first adhesive strip 30 and a second adhesive strip 40. This particular embodiment can be suited for a two vane wrap, to attach two arrow vanes to an archery arrow 100 at about 180° offset relative to one another as shown in FIG. 8. The base 20 can be in the form of a sheet, also referred to as a base sheet. The base sheet can be constructed from a polymeric film, a plastic layer, a high density paper, or other sheet materials. As shown in FIGS. 1 and 2, the base sheet can be constructed initially in a flat, planar, or rectangular form, generally as a two dimensional sheet. Such sheets can be produced or cut from stacks of larger sheets, or optionally cut from longer rolls of material. The sheet 20 can include a first side edge 21 and a second side edge 22 opposite one another, across the longitudinal axis LA. These side edges can be separated from one another by the base width BW. The side edges can be parallel to one another. The base 20 also can include a first end edge 25 and a second end edge 26 distal from one another, at opposite ends of the length BL of the base sheet. The end edges can be parallel to one another.

Figure 5:
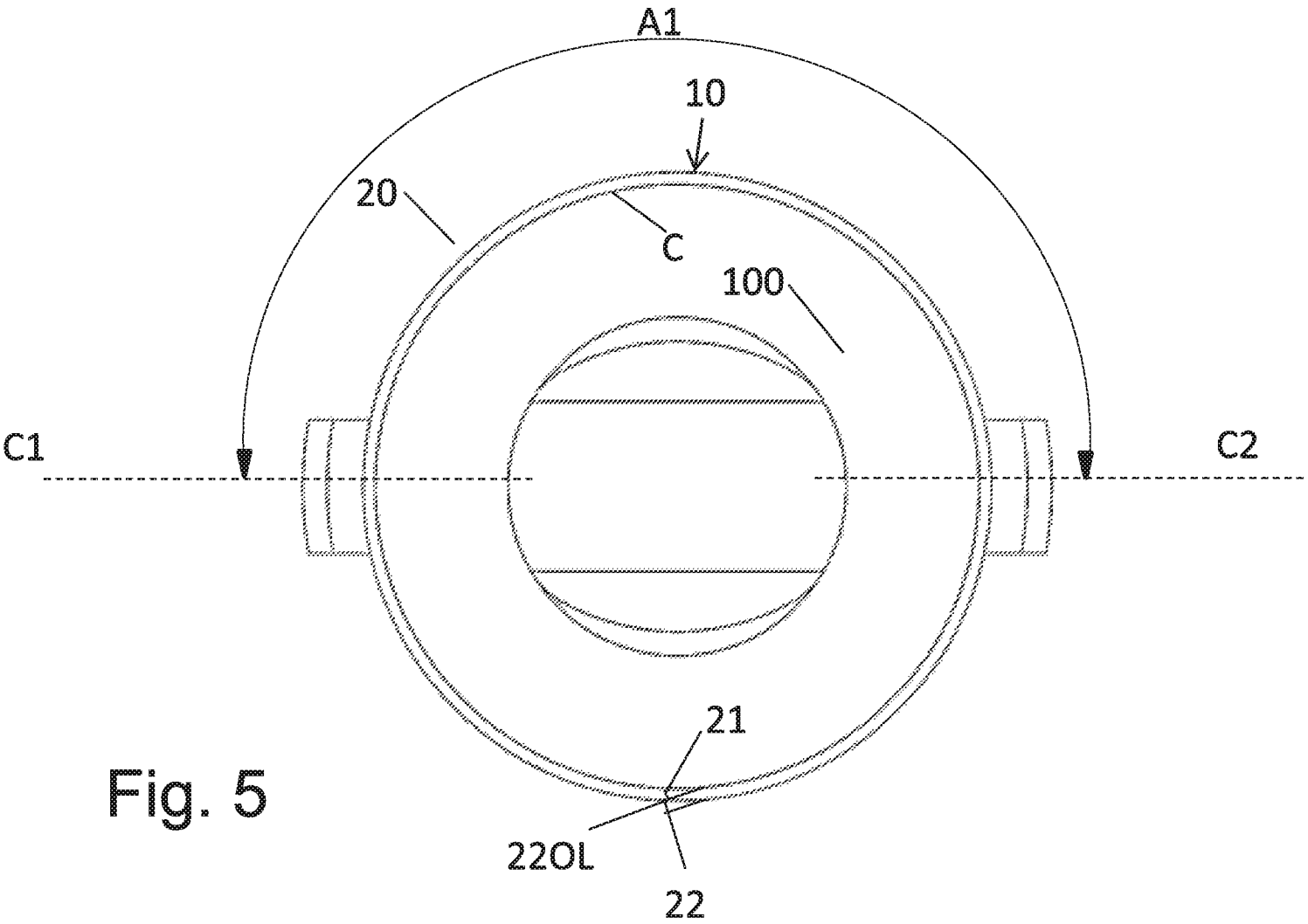
FIG. 5 is a rear view thereof.

The base or base sheet shown in FIGS. 1 and 2 can include a base width BW, a longitudinal axis LA and a base length BL extending along the longitudinal axis. The base width BW can be of a particular relationship to a circumference of an arrow 100 to which the vane wrap is to be attached. For example, the base width BW can be equal to the circumference C of the outer or exterior surface of the arrow as shown in FIG. 5, or slightly greater. In particular, where the base width is exactly equal to the circumference C, the side edges 21 and 22 can abut against one another. In this case, the base width BW can be equal to or slightly less than the circumference C of the arrow. In other cases, the base width BW can be slightly greater than the circumference C, in which case the one side edge 22 can overlap the other side edge 21 in an overlap region 220L having a miniscule overlap width or area. Of course, the overlap region can be determine based on the amount of overlap on a particular wrap 10, depending on the arrow size, diameter or material. In some cases, the overlap can be about 0.01 inches, 0.02 inches, 0.03 inches, 0.04 inches, 0.05 inches, 0.10 inches, 0.20 inches, or other amounts in width, depending on the application. Optionally, the overlap regions extends the length BL of the base, and is parallel to the longitudinal axis LA. Further optionally, the base width BW includes the width of the overlap region 220L so that the overall base width can be greater than the circumference C of the arrow. In this case, the overlap region and associated side edge of the base can overlap an opposing side edge when the vane wrap is applied to an arrow exterior surface, around its circumference.

Figure 3:
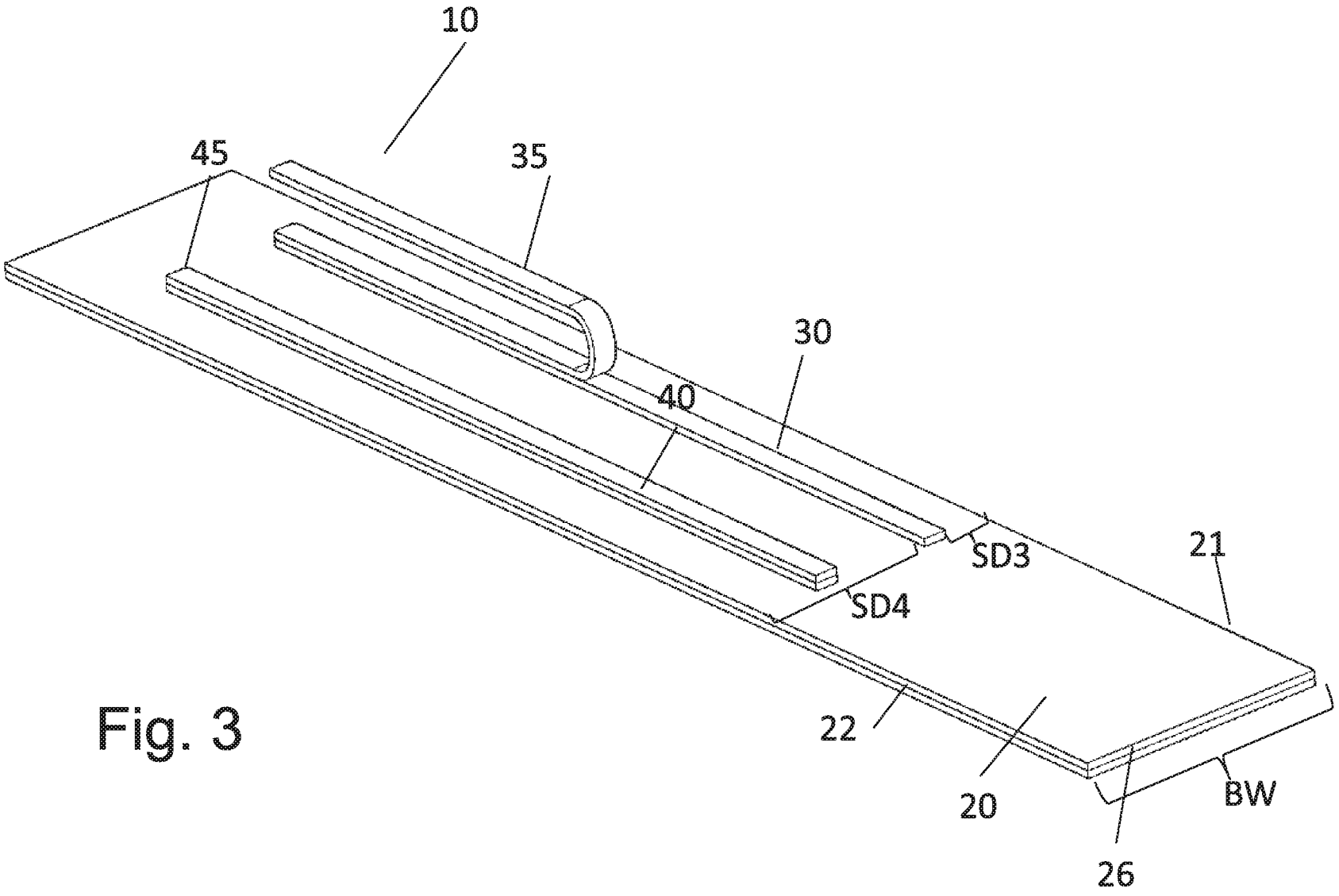
FIG. 3 is a perspective view of a release liner being removed from an adhesive strip.

With reference to FIGS. 1-3, the base or base sheet can include a lower base surface 24 and an upper base surface 23, opposite one another. The lower surface can include a base adhesive layer. The layer 50 can be a pressure sensitive adhesive, a tacky adhesive, a cement layer, a glue layer or any other type of adhesive. The layer 50 can be coextensive with the entire lower surface 24 of the base sheet 20. It can extend across the base width BW and along the base length BL of the base sheet.

The vane wrap 10 also can include a base release liner 60 covering and/or concealing the base adhesive layer so that the base adhesive layer does not engage a surface unintentionally and bond or secure the vane wrap to that surface before installation on an arrow. The base release liner 60 can be disposed over the lower surface of the base sheet, separated at least partially from the base sheet via the adhesive layer sandwiched therebetween. The base release liner 60 can be in the form of a sheet as well. It can extend across the base width BW and along the base length BL, coextensive with the base sheet 20. The base release liner can have a base liner width equal to the base width BW and a base liner length equal to the base liner length BL. Of course, where the adhesive layer 50 is of a different shape or format from the base sheet, the release liner can extend primarily across that layer in a similar manner to cover the adhesive.

With reference to FIGS. 1-3, the vane wrap 10 also includes first 30 and second 40 adhesive strips in the two vane embodiment shown. As described below, additional adhesive strips can be added to secure additional vanes to the vane wrap and thus the arrow. The first adhesive strip 30 can be disposed on the upper surface 23 and can extend substantially parallel to the longitudinal axis LA. The first adhesive strip 30 can include a first length L1 and a first width W1. Due to its elongated configuration, which can be sized to correspond to a lower base surface of a vane, the first adhesive strip 30 can have the first width L1 less than the first width W1, and substantially less than the base width BW. Further, the first length L1 can be less than the base length BL of the base 20. In this case, the first or upper end 35 of the adhesive strip 30 can be spaced or separated from the first end edge 25 by a first separation distance SD1. The second or lower end of the first adhesive strip can be spaced or separated from the second end edge 26 by a second separation distance SD2. The second separation distance SD2 can be greater than the first separation distance SD1 but less than the length BL of the base sheet 20 as shown. Optionally, in other applications, the separation distances can be equal, or zero, so that the adhesive strip extends to the respective end edges of the sheet. Further, although not shown with specificity, the second adhesive strip can have identical separation distances as those of the first adhesive strip.

The first adhesive strip 30 also can be separated from the side edges of the base sheet by different separation distances. For example, as shown in FIG. 3, the first adhesive strip 30 can be separated from the first side edge by a third separation distance SD3. The first adhesive strip 30 can be separated from the second side edge by a fourth separation distance SD4. The fourth separation distance can be greater than the third separation distance but less than the width BW of the base sheet 20. The third separation distance SD3 optionally can be less than the first SD1 and second SD2 separation distances from the respective end edges 25 and 26. The fourth separation distance SD4 optionally can be less than the second SD2 separation distance but greater than the first SD1 separation distance from the respective end edges 25 and 26. Further optionally, the second adhesive strip can have identical separation distances as those of the first adhesive strip to the side edges, taking into account a slight overlap region. As an example, the separation distance between a second side edge 22 and the second strip 40 can be slightly greater than the third separation distance SD3 where the overlap region is on the second side edge 22. In such a case, the separation distance between a first side edge 21 and the second strip 40 can be less than the fourth separation distance SD4 where the overlap region is on the second side edge. In some cases, the first adhesive strip can be closer to the first side edge than the second adhesive strip, while the second adhesive strip can be closer to the second side edge than the first adhesive strip. These proportions and distances can be altered depending on the edge the overlap region is located, as well as whether there is or is not such an overlap region. Also, the adhesive strips can be placed in different locations across the base width in other applications, which can change the separation distances.

Turning to FIGS. 1-3, the second adhesive strip 40 also can be located on the upper surface and can extend substantially parallel to the longitudinal axis LA. The second adhesive strip 40 can include a second length L2 and a second width W2. Optionally, this length and width can be equal to the first length L1 and first width W1. Likewise, the second width W2 can be less than the base width BW, the second length L2 less than the base length BL. The second adhesive strip 40 can be substantially parallel to the first adhesive strip, but disposed across the longitudinal axis LA from the first adhesive strip 30. The first and second adhesive strips also can be substantially parallel to the longitudinal axis, which means they are between 0° and 5° offset from the longitudinal axis. The first and second strips also can be substantially parallel to one another, which means they are between 0° and 5° offset from one another.

With reference to FIG. 2, the first adhesive strip 30 and the second adhesive strip 40 can be separated from one another by a preselected distance. In some cases, the first adhesive strip 30 and the second adhesive strip 40 can be separated from one another by a distance less than ¼, ⅓ or ½ the width BW of the base sheet and/or the circumference C of an arrow to which the vane wrap is applied as described below. The preselected distance can correspond to predetermined angular orientation of a centerline C1 of the first adhesive strip 30 and an associated first vane V1 relative to a second centerline C2 of the second adhesive strip 40 and an associate second vane V2, when the first vane is attached to the first adhesive strip and the second vane is attached to the second adhesive strip, and when the base sheet is applied in an arcuate form around a circumference C of the arrow.

As shown in FIGS. 2 and 5, the first preselected distance P1 is between the first C1 and second C2 centerlines of the respective strips when the base sheet is in a planar form. This preselected distance P1 can be equal to the circumference C of an arrow to which the wrap will be applied, divided by two, or C/2. In such a case, when the wrap 10 is applied to the arrow, the centerlines of the adhesive strips are disposed at a preselected angle A1 relative to one another. As shown in FIG. 5, that angle A1 can be 180°. Of course, other angles can be selected depending on the preselected distances as described further below.

With reference to FIG. 2, the centerlines also can be separated by predetermined distances from the closest side edges. For example, the centerline C1 can be separated from edge 21 by preselected distance P2. This distance can be equal to the circumference C of an arrow to which the wrap will be applied, divided by four, or C/4. The centerline C2 can be separated from edge 22 by preselected distance P3. This distance can be equal to the circumference C of an arrow to which the wrap will be applied, divided by four plus an overlap distance, or C/4 plus the width of the overlap region 220L that overlaps the edge 21 when the wrap is wrapped around an arrow and forms the overlap region due to the base width BW being greater than the circumference of the arrow.

The centerlines C1 and C2 of the respective adhesive strips also can be in a particular orientation relative to the longitudinal axis LA of the base sheet or vane wrap 10. For example, the first strip centerline can be on a first side of the longitudinal axis, while the second strip centerline can be on a second opposing side of the longitudinal axis. This can be the case regardless of how close the first strip is placed relative to the first side edge without extending beyond that edge 21.

The vane wrap 10 can include separate and independent release liners disposed over the respective adhesive strips 30 and 40. As shown in FIGS. 2 and 3, a first release liner 35 can cover the first adhesive strip 30. A second release liner 45 can cover the second adhesive strip 40. Each release liner can be adhesively but removably joined with the respective adhesive strip. The first release liner 35 can be separate and independent from the second release liner 45 so that the first release liner 35 can be completely removed from the first adhesive strip 30 while the second release liner 40 remains joined with the second adhesive strip 40 to conceal the second adhesive strip 40. With this construction, each release liner can be removed at different times and non-simultaneously from the adhesive strips as described below.

Optionally, the first release liner 45 includes a first length and the second release liner includes a second length. The first length and second length can be equal to one another and less than the base length BL as shown. The release liners can be coextensive with each of the respective adhesive strips. The release liners can have lengths optionally less than three quarters, less than two thirds, or less than one half the length of the base BL. The release liners also can be spaced from the side edges and end edges similar to the adhesive strips which they cover. The first release liner also can include a first width and the second release liner can include a second width. The first width and the second width can be optionally less than ½, less than ⅓, less than ¼ or other portions of the base liner width or base width BW.

As shown, the release liners are separate and independent, with one capable of being removed from one adhesive strip without pulling the other release liner off the other strips. Optionally, the release liners can be connected, however, for example, a remnant strip (not shown) can extend across from one liner to the other over the upper surface of the base to connect two or more release liners. One liner can be removed from one strip, and then can dangle via an attachment to the other remaining installed liner. Further optionally, the first release liner and second release liner can be formed of a continuous unitary strip wide enough to cover both adhesive strips.

A method of installing the vane wrap 10 to an arrow will now be described. In general, the method can include the following steps: providing the vane wrap; removing a base release liner from the base adhesive layer; adhering the base sheet around a circumference of an archery arrow with the base adhesive layer so that the vane wrap follows the contours of the archery arrow and wraps around the circumference; removing a first release liner from the first adhesive strip; applying a first vane to the first adhesive strip; removing a second release liner from the second adhesive strip; and applying a second vane to the second adhesive strip. Where more adhesive strips and release liners are included on the vane wrap, the release liners can be removed and the additional vanes installed.

More particularly, a user can obtain a vane wrap 10 and lay it out in a planar form. The base release liner 60 can be removed from the base adhesive layer 50. The first and second release liners remain attached to the first and second strips 30 and 40. The base sheet 20 can be turned over, adhesive layer 60 facing up, optionally on a rolling pad. The user can take a clean archery arrow and place it adjacent the base sheet, aligning the upper or first end edge with the end of the cylindrical arrow shaft. The user can roll the arrow as straight as possible to adhere the base sheet around the circumference of the arrow as the arrow rolls over. During the rolling, the base sheet adheres to the contours of the arrow, changing from a planar configuration to a curved configuration, wrapping around the arrow's circumference. The base sheet 20 adheres to the arrow until the second end edge 22 overlaps the first end edge 21 to create the overlap region 220L where the base width BW is greater than the circumference C of the arrow. The overlap region can be pressed down to secure the vane in place.

Figure 4:
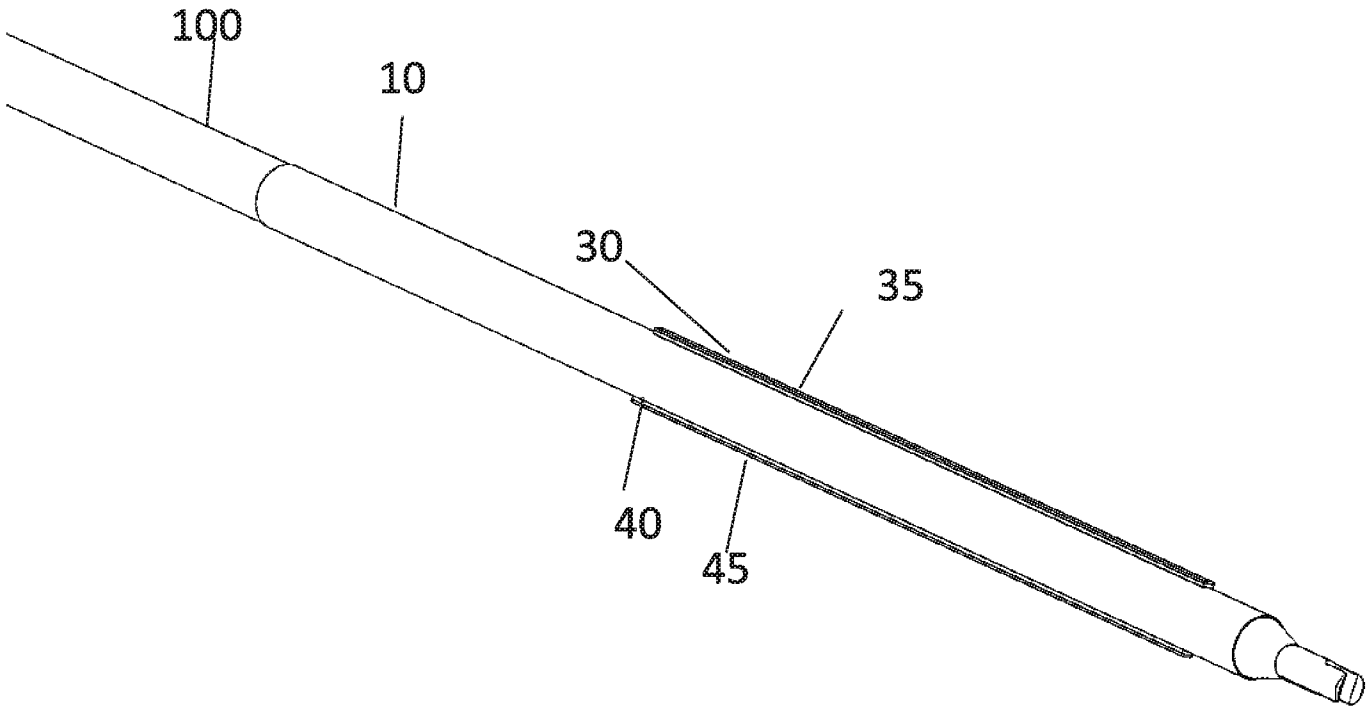
FIG. 4 is a perspective view of the vane wrap adhered to an arrow.
Figure 6:
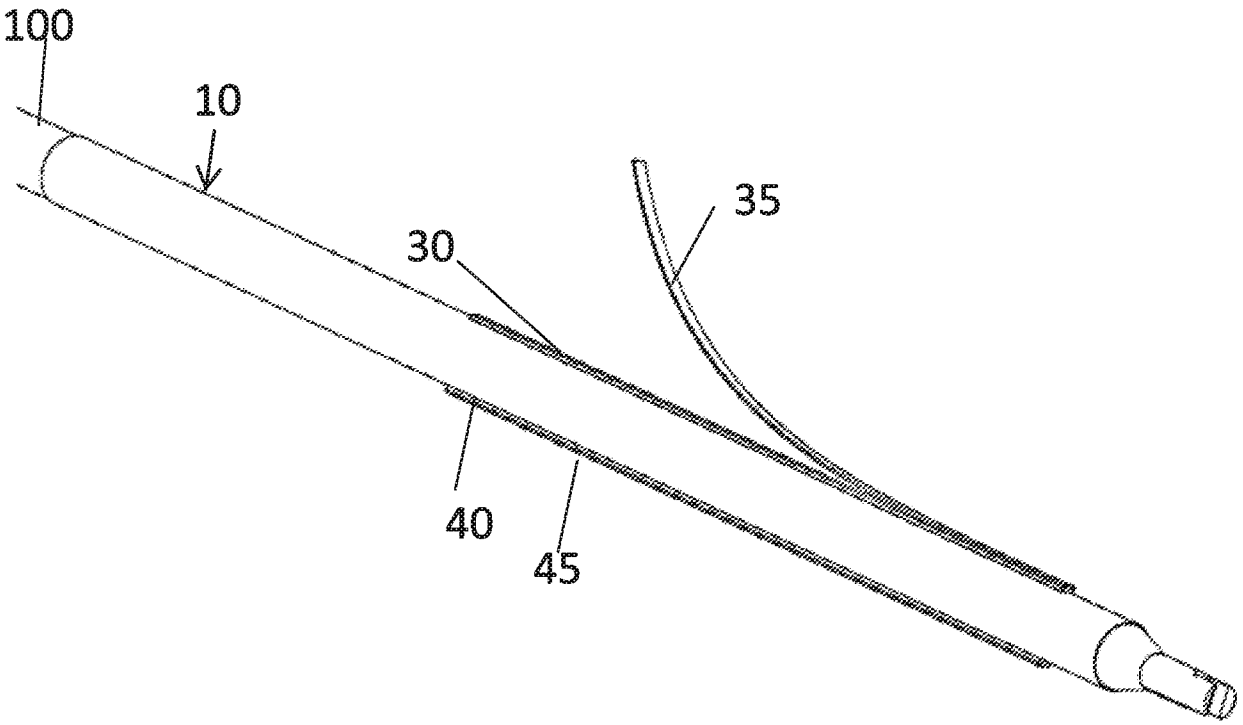
FIG. 6 is a perspective view of a release liner being pulled from an adhesive strip.
Figure 7:
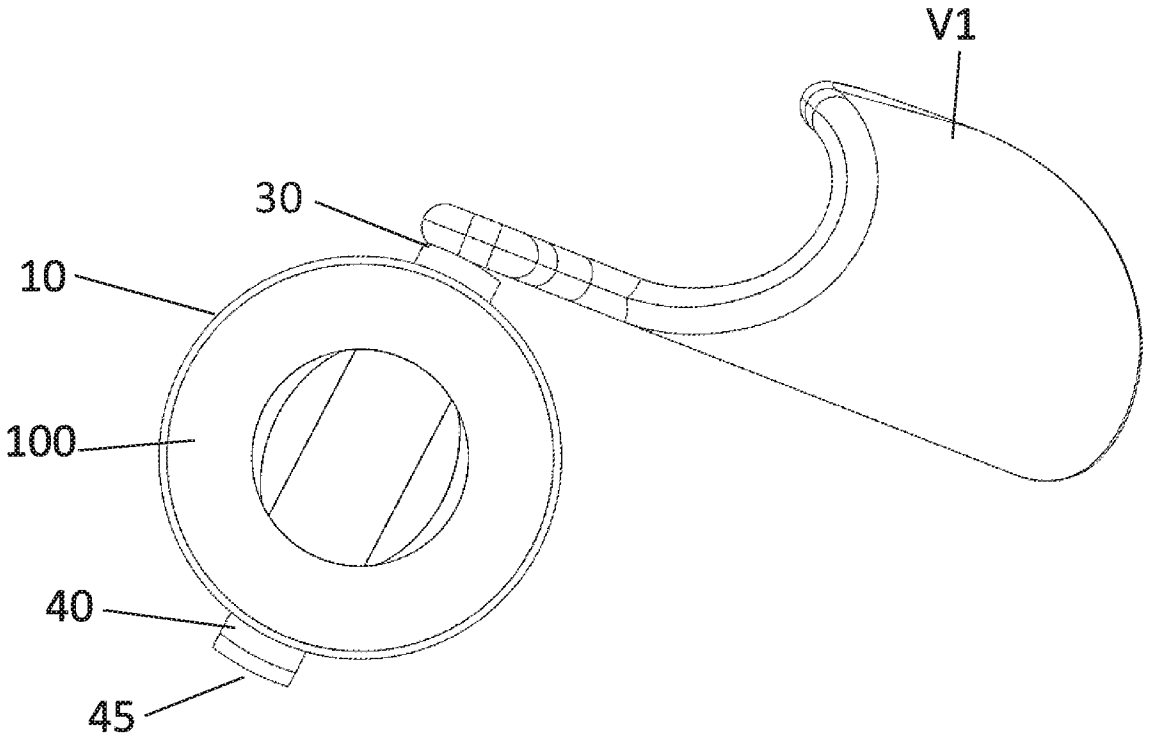
FIG. 7 is a rear view of an arrow vane being applied to the adhesive strip to secure the arrow vane to the vane wrap and arrow.

With the vane wrap 10 installed on the arrow, the vane wrap has the configuration shown in FIGS. 4 and 5. The adhesive strips are still attached to the wrap and can be readied to install the vanes to secure them to the wrap and thus the arrow. To do so, as shown in FIGS. 3 and 6, the first release liner 35 can be removed from one side of the wrap 10 on the arrow 100 while the second release liner 45 remains attached to the vane wrap, covering the second adhesive strip 40. With the first release liner 35 fully removed, the first adhesive strip is exposed so that a first vane V1 can be applied to the adhesive strip 30 completely along its length. The vane V1 attaches to the adhesive strip so that the strip 30 is at least partially or substantially or entirely covered by the vane. The adhesive strip therefore attaches the vane V1 to the wrap 10 and thus to the arrow 100 as shown in FIG. 7. The second release liner 45, however, remains attached, covering the second strip 40 so that the adhesive remains uncontaminated and/or so that the strip does not attach to other objects while the first vane is attached on the other side of the arrow.

The vane V1 can be applied to the arrow with the vane secured at the nock end of the arrow first. The vane V1 can be place at or slightly inside the outer edge of the adhesive strip, depending on its width, which may or may not be greater than the width of the base of the vane V1. That end of the vane V1 can be held while the end farthest from the nock is also placed at or slightly inside the outer edge of the adhesive strip. The exposed vane edge can be rubbed and pushed into engagement with the entire length of the adhesive strip.

After the first vane V1 is attached to the first adhesive strip, shown in FIG. 7, the user can remove the second release liner 45 from the second strip 40 of adhesive to expose it. The user can then attach the second vane to the second strip in a manner similar to installation of the first vane to the first strip. With the vanes installed, the opposing ends of the installed vanes can be covered with a strip of tape wrapped around the arrow or circumference and over those ends and the base sheet, several times as desired. Any excess tape can be removed. Powder can be sprinkled on the excess tape to keep one arrow from sticking to another when placed near one another.

When the vanes are installed on the arrow, they can be disposed at an angle A1 taken between the respective centerlines C1 and C2 of the adhesive strips as shown in FIG. 5. Again, it is these centerlines and placement of the adhesive strips that automatically places the vanes in the angular orientation around the circumference of the arrow. Due to the repeatable and consistent placement of those strips on the base sheet, the vane wrap facilitates consistent and exceptional placement of the vanes with ease and efficiency for a variety of arrow sizes and diameters. The vane wrap can be dimensioned with the strips strategically placed, based on the measurement of the circumference of the particular arrow to which the vane wrap is to be secured.

The vanes installed on the vane wrap 10 can be constructed from a rigid or semi rigid but flexible material. This material can be a polymeric material, such as MYLAR®, natural or synthetic rubber, silicone, a composite material or other material. In some applications, the material can be an alloy or metallic. Generally, the material can retain its general shape as an associated arrow is accelerated and flies during flight. The material, however, can withstand the impact of the vane with a bow riser or an arrow rest without permanent deformation so that the vane can be used multiple times and provide similar aerodynamic effects on the arrow to which the vane is attached. Again, these aerodynamic effects can include spinning, rotating or otherwise reorienting the projectile to which the vane is attached.

A first alternative embodiment of the vane is illustrated in FIGS. 9-12. This vane 110 is similar in structure, function and operation to the vane 10 described in the embodiment above, with several exceptions. For example, this vane 110 includes a base sheet 120 and an adhesive layer 50 and a release liner 60, like the embodiment above. This vane wrap, however includes a first adhesive strip 130, a second adhesive strip 140 and a third adhesive strip 170 such that the vane wrap is configured to secure three vanes V1, V2 and V3 to an arrow such that the vanes are oriented around the circumference of the arrow at another angle A2, which can be about 120° offset relative to one another.

Figure 10:
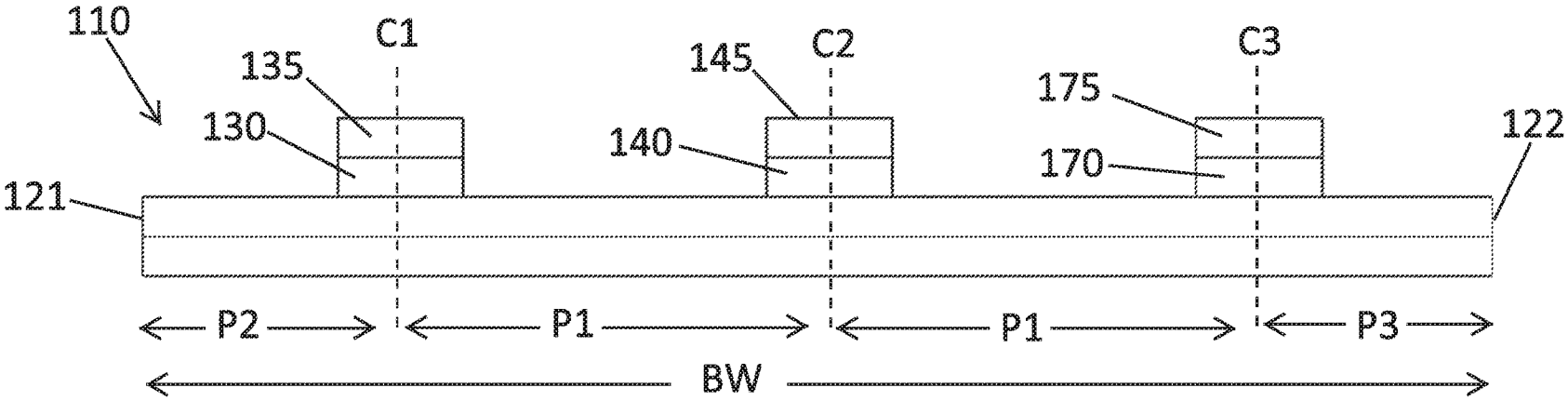
FIG. 10 is an enlarged top view thereof showing multiple adhesive strips on a base sheet with release liners attached to the adhesive strips and the base sheet.
Figure 11:
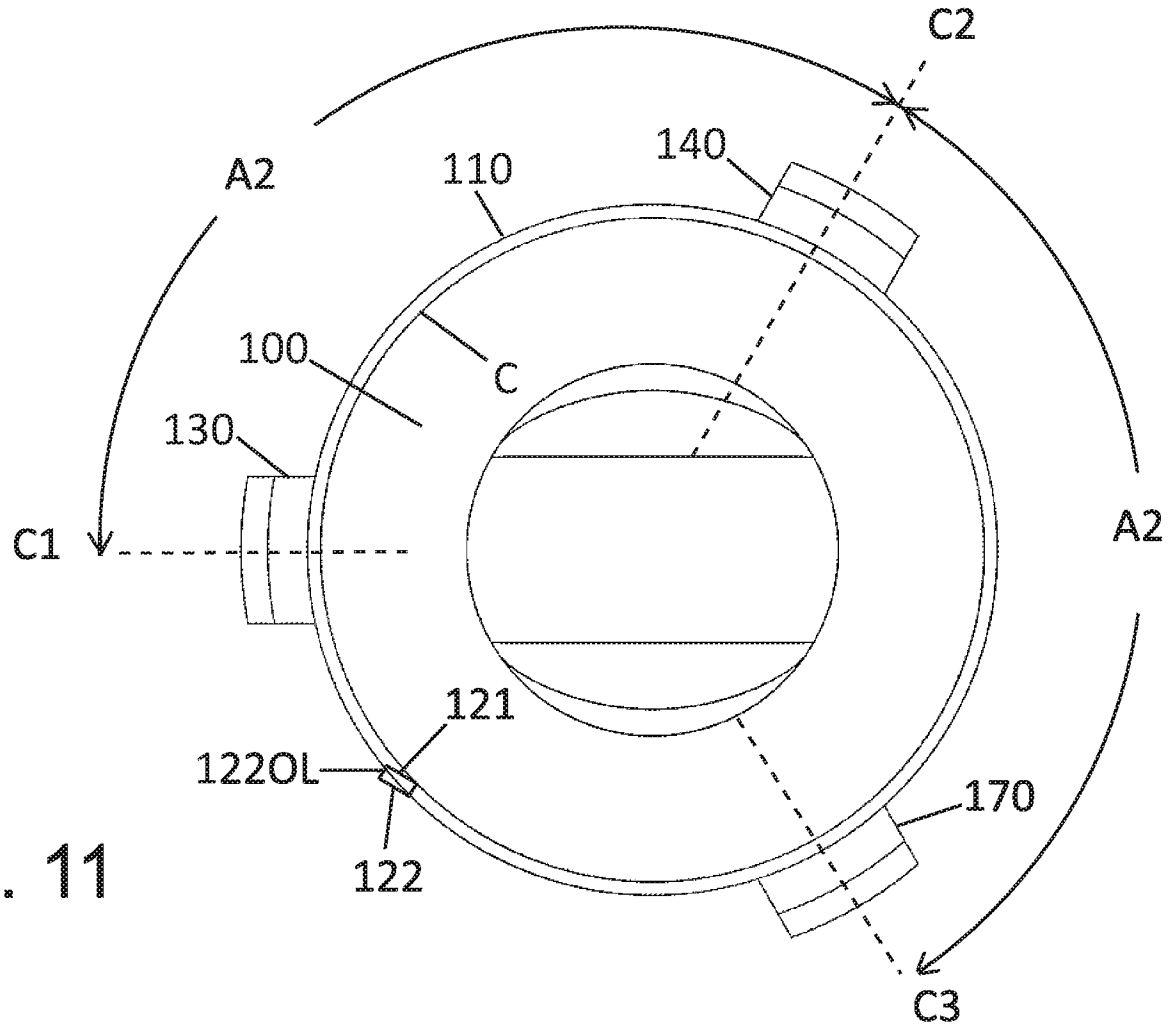
FIG. 11 is a rear view of arrow wrap applied to the arrow with the release liners in place.

As shown in FIGS. 10 and 11, the first preselected distance P1 is between the first C1, second C2 and third C3 centerlines of the respective strips when the base sheet is in a planar form. This distance P1 can be equal between the strip centerlines. This preselected distance P1 can be equal to the circumference C of an arrow to which the wrap will be applied, divided by three, or C/3. In such a case, when the wrap 110 is applied to the arrow, the centerlines of the adhesive strips are disposed at a preselected angle A2 relative to one another. As shown in FIG. 11, that angle A2 can be 120°. Of course, other angles can be selected depending on the preselected distances.

With reference to FIG. 2, the centerlines also can be separated by predetermined distances from the closest side edges. For example, the centerline C1 can be separated from edge 121 by preselected distance P2. This distance can be equal to the circumference C of an arrow to which the wrap will be applied, divided by five, or C/5. The centerline C2 can lay adjacent but slightly offset from the longitudinal axis LA. The centerline C2 can be separated from centerline C1 by preselected distance P1 or C/3. The centerline C2 can be separated from edge 121 by preselected distance P3 plus P1. The centerline C3 can be separated from centerline C2 by preselected distance P1 again. The centerline C3 can be separate from the second edge 122 by preselected distance P3. This distance can be equal to the circumference C of an arrow to which the wrap will be applied, divided by five plus an overlap distance, or C/5 plus the width of the overlap region 1220L that overlaps the edge 121 when the wrap 110 is wrapped around an arrow and forms the overlap region due to the base width BW being greater than the circumference of the arrow. This overlap region is shown in FIG. 11.

Figure 12:
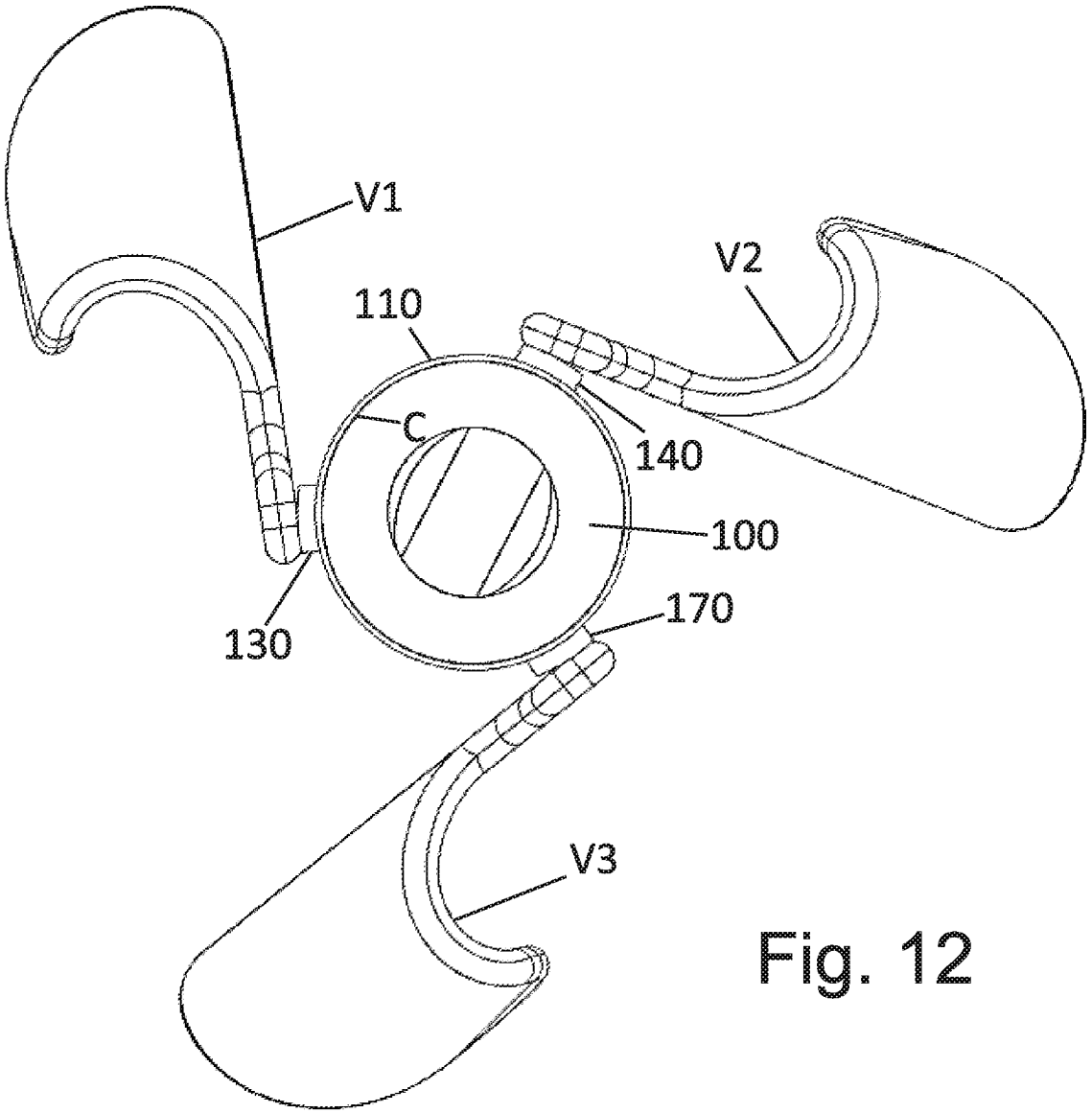
FIG. 12 is a rear view of arrow vanes applied to the arrow via the vane wrap.

The method of installing the arrow wrap 110 of this embodiment is virtually identical to that of installing the arrow wrap 10 as described above, except that one more release liner 175 is removed to reveal another adhesive strip 170 to install a third vane V3, in addition to the other vanes V1 and V2 as shown in FIG. 12.

The various components and features of the embodiments herein, for example, the archery vane and its components, can take on a variety of aesthetic forms, shapes and sizes. Although a particular component or feature can have a function, that feature can be expressed in different aesthetic manners to form an artistic design and/or purely ornamental design.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A vane wrap adapted to secure a plurality of vanes about a circumference of an archery arrow, the vane wrap comprising:

a base sheet of a rectangular form including a lower base surface and an upper base surface, the base sheet including a base width that is greater than a circumference of a cylindrical projectile to which the base sheet is configured to attach, the base sheet including a longitudinal axis and a base length extending along the longitudinal axis;

a base adhesive layer disposed on the lower surface across the base width and along the base length;

a first adhesive strip on the upper surface and extending substantially parallel to the longitudinal axis, the first adhesive strip including a first length and a first width, the first width less than the base width, the first length less than the base length; and a second adhesive strip on the upper surface and extending substantially parallel to the longitudinal axis, the second adhesive strip including a second length and a second width, the second width less than the base width, the second length less than the base length, the second adhesive strip being substantially parallel to the first adhesive strip, but disposed across the longitudinal axis from the first adhesive strip, wherein the first adhesive strip and the second adhesive strip are separated from one another by a preselected distance when the base sheet is in a planar form, wherein the preselected distance corresponds to a predetermined angular orientation of a first vane relative to a second vane when the first vane is attached to the first adhesive strip and the second vane is attached to the second adhesive strip, and when the base sheet is applied in an arcuate form around a circumference of the cylindrical projectile, wherein at least one release liner is removably disposed over at least one of the first adhesive strip and the second adhesive strip.

2. The vane wrap of claim 1, wherein the first adhesive strip includes a first strip centerline, wherein the second adhesive strip includes a second strip centerline, wherein the base sheet includes a first side edge and a second side edge, an upper edge and a lower edge, wherein the first strip centerline is separated from the second strip centerline by about ½ the circumference of a cylindrical projectile to which the base sheet is configured to attach, wherein the first adhesive strip is closer to the first side edge than the second adhesive strip, wherein the first strip centerline is on a first side of the longitudinal axis, wherein the second strip centerline is on a second opposing side of the longitudinal axis.

3. The vane wrap of claim 1, wherein the first adhesive strip includes a first strip centerline, wherein the second adhesive strip includes a second strip centerline, wherein the base sheet includes a first side edge and a second side edge, an upper edge and a lower edge, wherein the first strip centerline is separated from the second strip centerline by about ⅓ the circumference of a cylindrical projectile to which the base sheet is configured to attach, wherein the first adhesive strip is closer to the first side edge than the second adhesive strip.

4. The vane wrap of claim 1, wherein the first adhesive strip includes a first strip centerline, wherein the second adhesive strip includes a second strip centerline, wherein the base sheet includes a first side edge and a second side edge, an upper edge and a lower edge, wherein the first adhesive strip is spaced a first distance from the first side edge, wherein the second adhesive strip is spaced a second distance from the second side edge, wherein the second distance is greater than the first distance, wherein the first adhesive strip is closer to the first side edge than the second adhesive strip, wherein the second adhesive strip is closer to the second side edge than the first adhesive strip.

5. The vane wrap of claim 1, wherein the base sheet includes a first side edge and a second side edge opposite one another, across the longitudinal axis, and a first end edge and a second end edge distal from one another, at opposite ends of the length of the base sheet, wherein the first adhesive strip is separated from the first end edge by a first separation distance, wherein the first adhesive strip is separated from the second end edge by a second separation distance, wherein the second separation distance is greater than the first separation distance but less than the length of the base sheet.

6. The vane wrap of claim 5, wherein the first adhesive strip is separated from the first side edge by a third separation distance, wherein the first adhesive strip is separated from the second side edge by a fourth separation distance, wherein the fourth separation distance is greater than the third separation distance but less than the width of the base sheet.

7. A vane wrap adapted to secure a plurality of vanes about a circumference of an archery arrow, the vane wrap comprising:

a base sheet of a rectangular form including a lower base surface and an upper base surface, the base sheet including a base width that is greater than a circumference of a cylindrical projectile to which the base sheet is configured to attach, the base sheet including a longitudinal axis and a base length extending along the longitudinal axis;

a base adhesive layer disposed on the lower surface across the base width and along the base length;

a first adhesive strip on the upper surface and extending substantially parallel to the longitudinal axis, the first adhesive strip including a first length and a first width, the first width less than the base width, the first length less than the base length;

a second adhesive strip on the upper surface and extending substantially parallel to the longitudinal axis, the second adhesive strip including a second length and a second width, the second width less than the base width, the second length less than the base length, the second adhesive strip being substantially parallel to the first adhesive strip, but disposed across the longitudinal axis from the first adhesive strip;

a first release liner adhesively but removably joined with the first adhesive strip; and a second release liner adhesively but removably joined with the second adhesive strip;

wherein the first release liner is separate and independent from the second release liner so that the first release liner can be completely removed from the first adhesive strip while the second release liner remains joined with the second adhesive strip to conceal the second adhesive strip wherein the first adhesive strip and the second adhesive strip are separated from one another by a preselected distance when the base sheet is in a planar form, wherein the preselected distance corresponds to a predetermined angular orientation of a first vane relative to a second vane when the first vane is attached to the first adhesive strip and the second vane is attached to the second adhesive strip, and when the base sheet is applied in an arcuate form around a circumference of the cylindrical projectile.

8. A vane wrap adapted to secure a plurality of vanes about a circumference of an archery arrow, the vane wrap comprising:

a base sheet of a rectangular form including a lower base surface and an upper base surface, the base sheet including a base width that is greater than a circumference of a cylindrical projectile to which the base sheet is configured to attach, the base sheet including a longitudinal axis and a base length extending along the longitudinal axis;

a base adhesive layer disposed on the lower surface across the base width and along the base length;

a first adhesive strip on the upper surface and extending substantially parallel to the longitudinal axis, the first adhesive strip including a first length and a first width, the first width less than the base width, the first length less than the base length; and a second adhesive strip on the upper surface and extending substantially parallel to the longitudinal axis, the second adhesive strip including a second length and a second width, the second width less than the base width, the second length less than the base length, the second adhesive strip being substantially parallel to the first adhesive strip, but disposed across the longitudinal axis from the first adhesive strip, wherein the first adhesive strip and the second adhesive strip are separated from one another by a preselected distance when the base sheet is in a planar form, wherein the preselected distance corresponds to a predetermined angular orientation of a first vane relative to a second vane when the first vane is attached to the first adhesive strip and the second vane is attached to the second adhesive strip, and when the base sheet is applied in an arcuate form around a circumference of the cylindrical projectile, wherein the first adhesive strip and the second adhesive strip are each a pressure sensitive adhesive layer applied to the base sheet while the base sheet is in a planar form, before the base sheet is applied to the cylindrical projectile.

9. The vane wrap of claim 8, wherein the first adhesive strip and the second adhesive strip are separated from one another by a distance about ½ the width of the base sheet.

10. A vane wrap adapted to secure a plurality of vanes about a circumference of an archery arrow, the vane wrap comprising:

a base sheet of a rectangular form including a lower base surface and an upper base surface, the base sheet including a base width that is greater than a circumference of a cylindrical projectile to which the base sheet is configured to attach, the base sheet including a longitudinal axis and a base length extending along the longitudinal axis;

a base adhesive layer disposed on the lower surface across the base width and along the base length;

a first adhesive strip on the upper surface and extending substantially parallel to the longitudinal axis, the first adhesive strip including a first length and a first width, the first width less than the base width, the first length less than the base length; and a second adhesive strip on the upper surface and extending substantially parallel to the longitudinal axis, the second adhesive strip including a second length and a second width, the second width less than the base width, the second length less than the base length, the second adhesive strip being substantially parallel to the first adhesive strip, but disposed across the longitudinal axis from the first adhesive strip;

a first release liner adhesively but removably joined with the first adhesive strip on the upper surface of the base sheet; and a second release liner adhesively but removably joined with the second adhesive strip on the upper surface of the base sheet;

a base release liner adhesively but removably joined with the base adhesive layer on the lower surface, the base release liner extending across the base width and along the base length, coextensive with the base sheet, wherein the first adhesive strip and the second adhesive strip are separated from one another by a preselected distance when the base sheet is in a planar form, wherein the preselected distance corresponds to a predetermined angular orientation of a first vane relative to a second vane when the first vane is attached to the first adhesive strip and the second vane is attached to the second adhesive strip, and when the base sheet is applied in an arcuate form around a circumference of the cylindrical projectile.

11. The vane wrap of claim 10, wherein the first release liner includes a first length and the second release liner includes a second length, wherein the first length and second length are equal to one another and less than the base length.

12. The vane wrap of claim 11, wherein the base release liner has a base liner width equal to the base width, wherein the first release liner includes a first width and the second release liner includes a second width, wherein the first width and the second width are less than ½ the base liner width.

13. A vane wrap adapted to secure a plurality of vanes about a circumference of an archery arrow, the vane wrap comprising:

a base sheet including a lower base surface and an upper base surface, the base sheet including a base width, a longitudinal axis and a base length extending along the longitudinal axis;

a base adhesive layer disposed on the lower surface;

a first adhesive strip disposed on the upper surface; and a second adhesive strip disposed on the upper surface, the second adhesive strip being substantially parallel to the first adhesive strip, but disposed across the longitudinal axis from the first adhesive strip, wherein at least one release liner is removably disposed over at least one of the first adhesive strip and the second adhesive strip.

14. The vane of claim 13, wherein the first adhesive strip includes a first strip centerline, wherein the second adhesive strip includes a second strip centerline, wherein the base sheet includes a first side edge and a second side edge, an upper edge and a lower edge, wherein the first strip centerline is separated from the second strip centerline by at least one of about ½ and about ⅓ the circumference of a cylindrical projectile to which the base sheet is configured to attach, wherein the first adhesive strip is closer to the first side edge than the second adhesive strip, wherein the first strip centerline is on a first side of the longitudinal axis, wherein the second strip centerline is on a second opposing side of the longitudinal axis.

15. A vane wrap adapted to secure a plurality of vanes about a circumference of an archery arrow, the vane wrap comprising:

a base sheet including a lower base surface and an upper base surface, the base sheet including a base width, a longitudinal axis and a base length extending along the longitudinal axis;

a base adhesive layer disposed on the lower surface;

a first adhesive strip disposed on the upper surface;

a second adhesive strip disposed on the upper surface, the second adhesive strip being substantially parallel to the first adhesive strip, but disposed across the longitudinal axis from the first adhesive strip;

a first release liner covering the first adhesive strip; and a second release liner covering the second adhesive strip, the second release liner distal from the first release liner, with each laying on opposing sides of the longitudinal axis.

16. The vane of claim 15 comprising:

a base release liner covering the base adhesive layer, the base release liner extending across the base width and along the base length, coextensive with the base sheet.

17. The vane of claim 15, wherein first release liner is narrower and shorter than the base width and the base length, wherein the release liner is narrower and shorter than the base width and the base length.

18. A method of installing vanes on an archery arrow, the method comprising:

providing a vane wrap including a base sheet having a base adhesive layer on a lower surface, a first adhesive strip on the upper surface, and a second adhesive strip on the upper surface, removing a base release liner from the base adhesive layer;

adhering the base sheet around a circumference of an archery arrow with the base adhesive layer so that the vane wrap follows the contours of the archery arrow and wraps around the circumference;

removing a first release liner from the first adhesive strip;

applying a first vane to the first adhesive strip;

removing a second release liner from the second adhesive strip; and applying a second vane to the second adhesive strip.

19. The method of claim 18 comprising:

removing a third release liner from a third adhesive strip on the base sheet; and applying a third vane to the third adhesive strip.

20. The method of claim 18, wherein the base sheet is in a planar form before the adhering step, wherein the base sheet includes a first side edge and a second side edge, wherein the base sheet is curved during the adhering step, wherein the first side edge overlaps the second side edge after the base sheet is wrapped on the archery arrow.

* * * * *